United States Patent [19]

Sharpe

[11] Patent Number: 4,760,980

[45] Date of Patent: Aug. 2, 1988

[54] METHOD AND APPARATUS FOR PATCHING AN OPENING WITHIN A SCREEN

[76] Inventor: William Sharpe, Whitehall Shores, Camden, N.C. 27921

[21] Appl. No.: 571,931

[22] Filed: Jan. 19, 1984

[51] Int. Cl.[4] ..... A47H 3/00

[52] U.S. Cl. ..... 245/2; 160/237

[58] Field of Search ..... 24/306; 2/48, 122; 29/450, 453; 245/1, 2, 5; 428/99, 100; 160/237

[56] References Cited

U.S. PATENT DOCUMENTS

| | | | |
|---|---|---|---|
| 3,261,393 | 7/1966 | Templeton | 160/237 |
| 3,658,107 | 4/1972 | Perina | 24/306 X |
| 3,753,458 | 8/1973 | Lazarek | 160/DIG. 2 X |
| 4,403,366 | 9/1983 | Lucke | 24/306 X |

*Primary Examiner*—Timothy V. Eley

*Attorney, Agent, or Firm*—Rhodes, Coats & Bennett

[57] ABSTRACT

The present invention relates to a method and apparatus for patching or covering an opening in a screen. A pair of patch covers are provided and there is provided cooperable fastening means associated with the backs of said patch covers for attaching the patch covers in back-to-back relationship. In use, the respective patch covers are disposed about opposite sides of the screen and the cooperating fastening means of each extend through the opening within the screen so as to fasten and connect the two patch covers together in close side-by-side relationship. Being attached, the two patch covers are secured together so as to effectively cover and patch the opening formed in the screen.

1 Claim, 2 Drawing Sheets

METHOD AND APPARATUS FOR PATCHING AN OPENING WITHIN A SCREEN

FIELD OF INVENTION

The present invention relates to patch covers and patching devices for screens, and more particularly to screen patching devices that utilize attaching means to attach the patch cover about the screen so as to effectively close or cover an opening that is to be patched.

BACKGROUND OF INVENTION

Patching an opening within a wire or fiberglass screen can be tedious and troublesome, not to mention the fact that they often are very noticable and do not blend well into the screen itself.

In reviewing the prior art in the area of screen patching, there is found devices and methods such as those shown and disclosed in the following U.S. Pat. Nos. 1,749,755; 1,792,594; 1,927,826; 1,998,033; 2,283,803; 2,487,830; 2,272,196.

Most of the approaches to patching screens appear to be complicated and many involve attempting to place a screen type insert into the opening that is intended to be patched. This approach is especially difficult because the screen insert must be connected and intergrated to the main screen having the opening to be patched. Often, the utilization of a screen insert leaves a very noticable and sometimes unsightly screen area, again especially in the area where the insert is connected to the main screen. In addition, it is possible that in connecting these inserts within the main screen, that some jagged and sharp edges might be exposed so as to present a safety hazard to children.

Therefore, there has been and continues to be a need for a method and apparatus for patching screens that is relatively simple and easy and which after completion leaves a clean and neat area about the portion of the screen that has been patched.

SUMMARY AND OBJECTS OF INVENTION

The present invention entails a method and apparatus for patching fiberglass and wire screens that is designed to overcome the disadvantages and drawbacks of approaches found in the prior art. In particular, the present invention entails the provision of a "velcro" type screen patching device that is preferably designed to be of a decorative nature. A pair of patch covers are provided and are designed to be secured about opposite sides of a screen having an opening formed therein that is to be patched. The pair of patch covers include hook and loop type fastening means. Once placed adjacent opposite sides of the screen, the hook and loop type fastening means is effective to extend through the screen so as to attach the two patch covers together such that the patch covers themselves extend across to cover the opening to be patched.

It is therefore an object of the present invention to provide a screen patching device that is simple in design and which can be easily and conveniently attached to a screen so as to patch an opening formed therein.

A further object of the present invention is to provide a screen patching device that simply attaches and fits over an opening within a screen and which does not require that the patch be actually intergrated into the screen structure.

A further object of the present invention resides in the provision of a screen patching device that includes a pair of patch covers that are provided with cooperating fastening means disposed about the backsides of each and wherein in operation the cooperating fastening means is operative to extend through the plane of the screen to attach one cover to another cover so as to secure the pair of patch covers about the screen so as to extend across and to cover an existing opening formed therein.

It is also an object of the present invention to provide a screen patching device of the character referred to above that is durable and long lasting and which can withstand wind and other unfavorable weather conditions without becoming disattached from the screen.

A further object of the present invention is to provide a covering attachment for a screen that can be utilized as a safety device when the cover is attached to a screen that is disposed adjacent a glass door in which case the screen cover or screen attachment can serve to appraise individuals of the presence of the screen door when the glass door is opened.

Other objects and advantages of the present invention will become apparent from a study of the following description and the accompanying drawings which are merely illustrative of the present invention.

SCREEN PATCHING DEVICE

Figure 1:
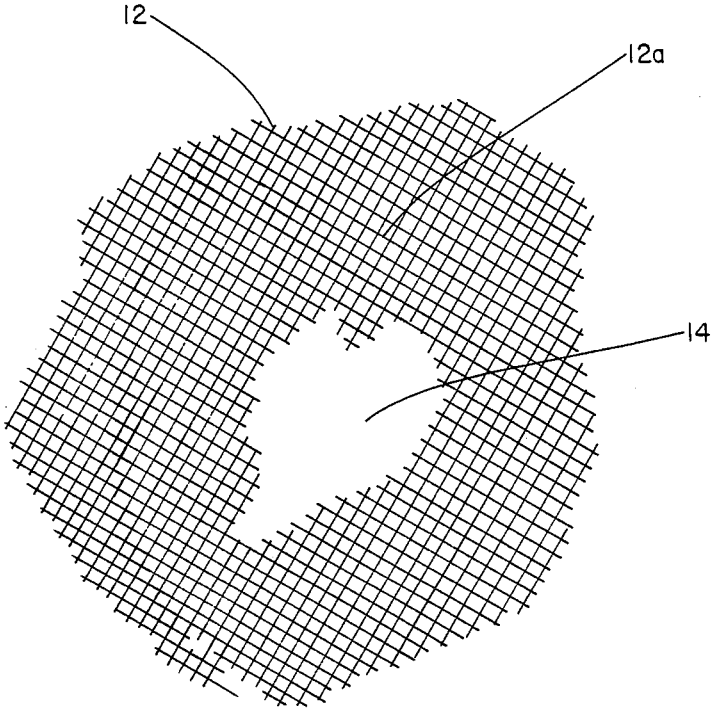
FIG. 1 is a side elevational view of a conventional screen having an opening formed therein, with the opening being of the type that is adapted to be patched by the screen patching device of the present invention.
Figure 2:
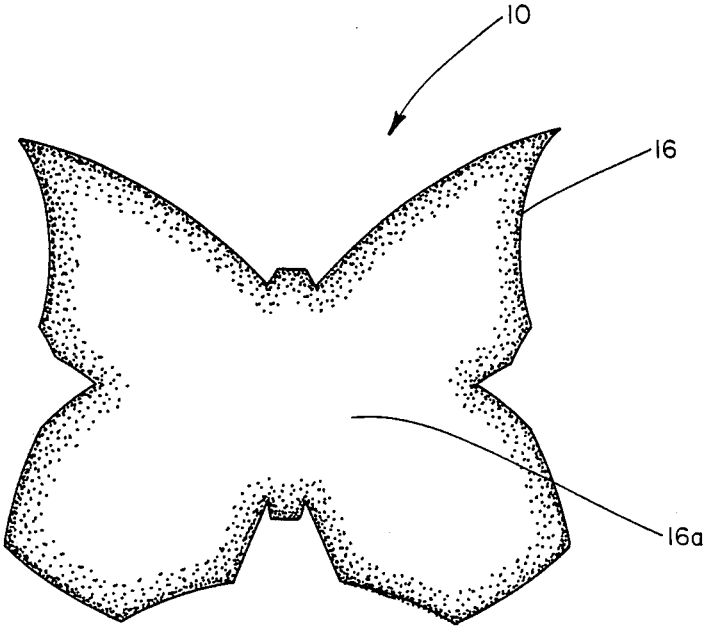
FIG. 2 is a side elevational view of the screen patching device of the present invention.
Figure 3:
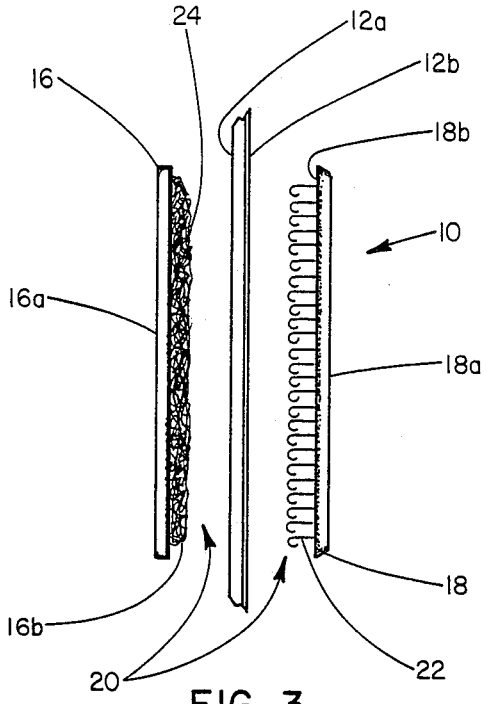
FIG. 3 is a side elevational view illustrating the dual piece screen patching device of the present invention spaced outwardly from each side of the screen to illustrate the attaching means associated with the respective pieces of the dual screen patching device.
Figure 4:
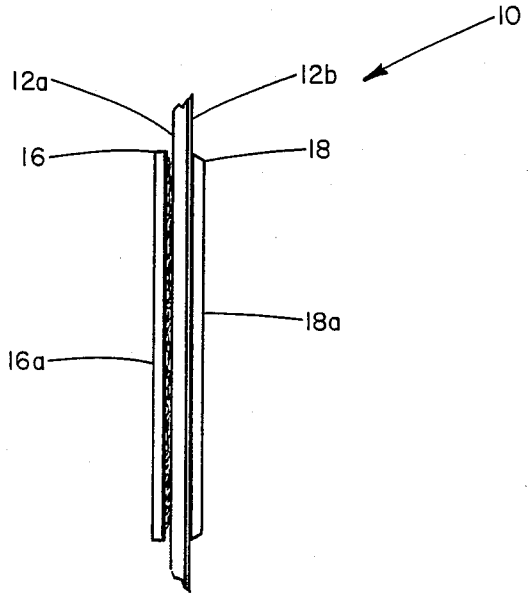
FIG. 4 is a view similar to FIG. 3 with the exception that dual piece screen patching device has been attached through the screen so as to effectively patch and cover any openings formed within a portion of the screen sandwiched between the patching device.

With further reference to the drawings, the screen patching device of the present invention is shown therein and indicated generally by the numeral 10.

Also shown in the drawing is a conventional screen 12 that can be constructed of either wire, fiberglass or any other material suitable for a screen. Screen 12 includes an outside side 12*a* and an inside side 12*b*. Screen 12 includes an opening 14 and it is this type of opening that the present screen patching device 10 is designed to patch.

Viewing screen patching device 10 in more detail, it is seen that the same basically comprises a dual piece construction comprised of an outside patch cover 16 that includes a front or face 16*a* and a backside 16*b*. Likewise, a second portion of the screen patching device 10 includes an inside patch cover 18 that includes a front or face 18*a* and a back 18*b*. It should be appreciated that these respective patch covers 16 and 18 can be constructed of any suitable material such as fabric, plastic, etc.

Formed and secured to the backs of the respective outside and inside patch covers 16 and 18 is fastening or attaching means 20 that is designed to enable the two patch covers 16 and 18 to be secured together in back-to-back relationship. In the present invention, attaching means 20 is in the form of a hook and loop type, fastener known commercially by the trademark "Velcro". In this regard, attaching means 20 is formed by providing a plurality of hooks about the back of one of the patch covers 16 or 18 while providing a series of loops 24 on the back of the other patch cover. It follows that the hooks 22 and the loops 24 are of the type that when the backs of the respective patch covers 16 and 18 are placed adjacent each other that the hooks 22 and loops 24 can be bounded or secured to each other so as to effectively secure one patch cover to the other.

In use, the screen patching device 10 of the present invention is selected such that the respective patch covers 16 and 18 are of a selected size and are generally of the same shape such that when secured in back-to-back relationship the two covers align.

To patch an opening, such as opening 14, a first patch cover, say for example outside patch cover 16, is placed adjacent the outside 12*a* of screen 12 such that the same extends over and covers opening 14. While the outside patch cover is held over opening 14, inside patch cover 18 is applied adjacent the inside 12*b* of screen 12 so as to again cover opening 14 and is particularly positioned such that it aligns with outside patch cover 16. Inside patch cover 18 is then pressed against screen 12 and against the back 16 of the outside patch cover 16. The attaching means 20 extends through the opening 14 and even through preexisting openings such that the hooks 22 and loops 24 attach in a very secure relationship that results in the two patch covers 16 and 18 being disposed closely adjacent each other and effectively covering and patching opening 14 formed in said screen.

It is appreciated that screen patching device 10 can be easily and conveniently removed from opening 14 as may be desired. In addition, it should be pointed out that the respective patch covers 16 and 18 can be cut into a particular design such as a butterfly, bird, etc., so as to give the screen patching device 10 of the present invention a decorative look.

From the foregoing specification and discussion it is appreciated that the screen patching device 10 of the present invention is very simple in design and can be easily and conveniently used to cover a wide variety of openings that inadverently occur or are found in screens. It is to be appreciated that the screen patching device 10 of the present invention does not have to be particularly shaped for a certain type, shape or size of opening as the same is designed to extend across and over the entire opening itself. Moreover, screen patching device 10 of the present invention has the advantage of not being required to be intergrated into the existing screen structure and particularly the area surrounding the opening to be patched. In the present application, the pair of patch covers 16 and 18 are simply placed on opposite sides of the screen, adjacent the opening to be patched, and are secured thereat by the attaching means 20 which effectively extends through the plane of the screen so as to actually secure the two patch covers together in back-to-back relationship.

The present invention, may of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claim are intended to be embraced therein.

What is claimed is:

1. A method for patching and covering an opening in a screen having two sides referred to as an outside and an inside comprising the steps of:

a. placing a backside of an outside patch cover adjacent the outside of said screen and extending said outside patch cover over said opening and a surrounding portion of the screen;

b. placing a backside of an inside patch cover adjacent the inside of said screen and extending said inside patch cover over said opening and the surrounding area of said screen;

c. providing cooperable fastening means about the back of each of said outside and inside patch covers;

d. projecting said fastening means through the plane of said screen and through the opening formed therein;

e. connecting the fastening means on the back of said outside patch cover with the fastening means on the back of said inside patch cover and attaching said outside patch cover to said inside patch cover in a close side-by-side relationship such that the screen extends therebetween and the presence of said inside and outside patch cover effectively covers and patches the opening within said screen;

f. and wherein the steps of providing said fastening means comprises placing a plurality of hooks over a substantial area of the backside of one of said covers and placing loops over a substantial area of the backside of the other cover;

g. wherein the steps of projecting and connecting said fastening means comprises projecting the hooks from a respective patch cover through the plane of said screen and hooking said hooks within said loops disposed on the backside of the other respective patch cover so as to secure said outside and inside patch covers together in close back-to-back relationship and h. wherein the steps of projecting and connecting said fastening means further includes the step of projecting said fastening means, including said hooks and loops, through the actual screen surrounding the opening.

* * * * *